US007513081B2

(12) United States Patent
Armstrong

(10) Patent No.: US 7,513,081 B2
(45) Date of Patent: Apr. 7, 2009

(54) PANEL LOCK BUILDING SYSTEM AND HINGE

(76) Inventor: Dan Armstrong, 427 Long Canyon Rd., Bradbury, CA (US) 91010

( * ) Notice: Subject to any disclaimer, the term of this patent is extended or adjusted under 35 U.S.C. 154(b) by 809 days.

(21) Appl. No.: 10/866,369

(22) Filed: Jun. 11, 2004

(65) Prior Publication Data

US 2005/0284074 A1 Dec. 29, 2005

(51) Int. Cl.
*E04H 1/00* (2006.01)

(52) U.S. Cl. ..... 52/79.1; 52/70.1; 52/79.9; 403/66

(58) Field of Classification Search ..... 52/70, 52/71, 293.3, 294, 293.2, 309.12, 309.17, 52/79.12, 79.9, 64, 69, 79.5, 79.4, 82, 126.6, 52/263, 588.1, 641; 403/66, 68, 70; 16/355; 160/229.1, 235

See application file for complete search history.

(56) References Cited

U.S. PATENT DOCUMENTS 172,980 A * 2/1876 Deetz ..... 52/70
388,424 A * 8/1888 Lindblad ..... 52/70
2,670,986 A * 3/1954 Presnell ..... 296/173
3,118,186 A * 1/1964 Moss ..... 52/71
3,139,958 A * 7/1964 De Witt ..... 52/70
3,324,831 A * 6/1967 St Onge ..... 119/499
3,338,005 A * 8/1967 Gelsavage ..... 52/70
3,341,987 A * 9/1967 Johansson ..... 52/70
3,353,317 A * 11/1967 Ensor ..... 52/309.2
3,469,873 A 9/1969 Glaros
3,555,758 A 1/1971 Schroter
3,608,267 A 9/1971 Curran
3,708,200 A * 1/1973 Richards ..... 296/173
3,733,767 A 5/1973 Craik
4,035,964 A * 7/1977 Robinson ..... 52/66
4,091,588 A 5/1978 Heirich
4,102,105 A 7/1978 Taylor et al.
4,109,427 A * 8/1978 O'Brian et al. ..... 52/58
4,118,901 A * 10/1978 Johnson ..... 52/18
4,173,855 A * 11/1979 Raptoplous ..... 52/82
4,177,615 A 12/1979 Anderson
4,192,117 A 3/1980 Heirich
4,269,012 A 5/1981 Mattingly et al.
4,337,606 A 7/1982 Reusser
4,522,005 A 6/1985 Seaburg et al.
4,570,404 A 2/1986 Knudson
4,602,853 A * 7/1986 Barr ..... 359/852
4,672,779 A * 6/1987 Boyd ..... 52/79.4
4,779,514 A * 10/1988 Prigmore et al. ..... 52/79.5
4,989,379 A * 2/1991 Suzuki ..... 52/66
5,117,596 A * 6/1992 Leslie et al. ..... 52/126.6
5,133,108 A 7/1992 Esnault
5,369,920 A * 12/1994 Taylor ..... 52/79.1

(Continued)

*Primary Examiner*—Richard E Chilcot, Jr.
*Assistant Examiner*—Anthony N Bartosik
(74) *Attorney, Agent, or Firm*—Christie, Parker & Hale, LLP.

(57) ABSTRACT

A panel lock building system is provided that includes a plurality of side panels forming an enclosure of a predetermined configuration. The system further includes a first hinge half attached to a first side edge of a plurality of the plurality of side panels and a second hinge half attached to a second side edge of a plurality of the plurality of side panels, such that each first hinge half is interlockingly coupled to a corresponding one of the second hinge halves to couple adjacent ones of the side panels.

13 Claims, 15 Drawing Sheets

U.S. PATENT DOCUMENTS 5,493,818 A * 2/1996 Wilson ..... 52/71
5,596,844 A * 1/1997 Kalinowski ..... 52/79.5
5,622,012 A * 4/1997 Schijf ..... 52/71
5,661,930 A * 9/1997 Porter ..... 52/64
5,706,624 A 1/1998 Lipson
5,794,393 A * 8/1998 Fearn ..... 52/294
6,085,469 A * 7/2000 Wolfe ..... 52/71
6,119,410 A * 9/2000 Wolfe ..... 52/71
6,173,547 B1 1/2001 Lipson
6,487,821 B1 * 12/2002 Thomsen et al. ..... 52/90.1
7,152,614 B2 * 12/2006 Kalnay ..... 135/128
7,290,378 B2 * 11/2007 Kalnay ..... 52/641
2002/0083654 A1 * 7/2002 Bini ..... 52/66

* cited by examiner

PANEL LOCK BUILDING SYSTEM AND HINGE

FIELD OF THE INVENTION

The present invention relates to a panel lock building system and to a hinge for use in a panel lock building system.

BACKGROUND

In disaster relief areas and in military posts, it is often desirable to construct temporary structures for shelter. In these settings temporary structures that may be quickly assembled without the use of tools or by minimal use of simple tools are particularly advantageous.

Tents have traditionally been used for such purposes. However, tents are often susceptible to deterioration by prolonged exposure to weather conditions, such as ultraviolet radiation, wind and rain. In addition, tents are typically relatively weak in terms of structural stability and strength, providing a relatively poor shelter structure.

Other temporary structures are more stable than tents. However, such shelters often contain components that are undesirably complicated, heavy, difficult to transport, and/or time consuming to assemble and disassemble. Accordingly, a need exists for an improved quick assemble building structure for use as a shelter.

SUMMARY

In an exemplary embodiment of the present invention, a panel lock building system is provided that includes a plurality of side panels forming an enclosure of a predetermined configuration. The system further includes a first hinge half attached to a first side edge of a plurality of the plurality of side panels and a second hinge half attached to a second side edge of a plurality of the plurality of side panels, such that each first hinge half is interlockingly coupled to a corresponding one of the second hinge halves to couple adjacent ones of the side panels.

In another exemplary embodiment of the present invention, the above described system further includes a roof to the above side panel enclosure. In this embodiment, each of the side panels is composed of a light weight material and the roof includes a plurality of light weight roof panels, wherein each of the plurality of side panels is hingedly connected to a corresponding one of the plurality of roof panels, and wherein the plurality of roof panels forms a roof to the side panel enclosure.

In yet another exemplary embodiment of the present invention, the combination of the two above described systems further includes a floor to the side panel enclosure including a plurality of floor panels, wherein each of the plurality of side panels is hingedly connected to a corresponding one of the plurality of floor panels, and wherein the plurality of floor panels forms a floor to said side panel enclosure. The system also includes a plurality of footings, wherein each footing is mounted to a lower portion of a corresponding one of the plurality of side panels to add stability to said side panel enclosure.

In still yet another exemplary embodiment of the present invention, a hinge having a first hinge half and a second hinge half is provided. The first hinge half includes an arm; a socket on one end of the arm; and a foot on an opposite end of the arm. The second hinge half includes an arm; a head on one end of the arm; and a foot on an opposite end of the arm. In this embodiment, the head of the second hinge half is removably and interlockingly connected to the socket of the first hinge half; and the foot of the second hinge half is removably and interlockingly connected to the foot of the first hinge half.

BRIEF DESCRIPTION OF THE DRAWINGS

Novel features in exemplary embodiments of the present invention will be better understood by reference to the following detailed description when considered in conjunction with the accompanying drawings wherein.

DETAILED DESCRIPTION

Figure 1:
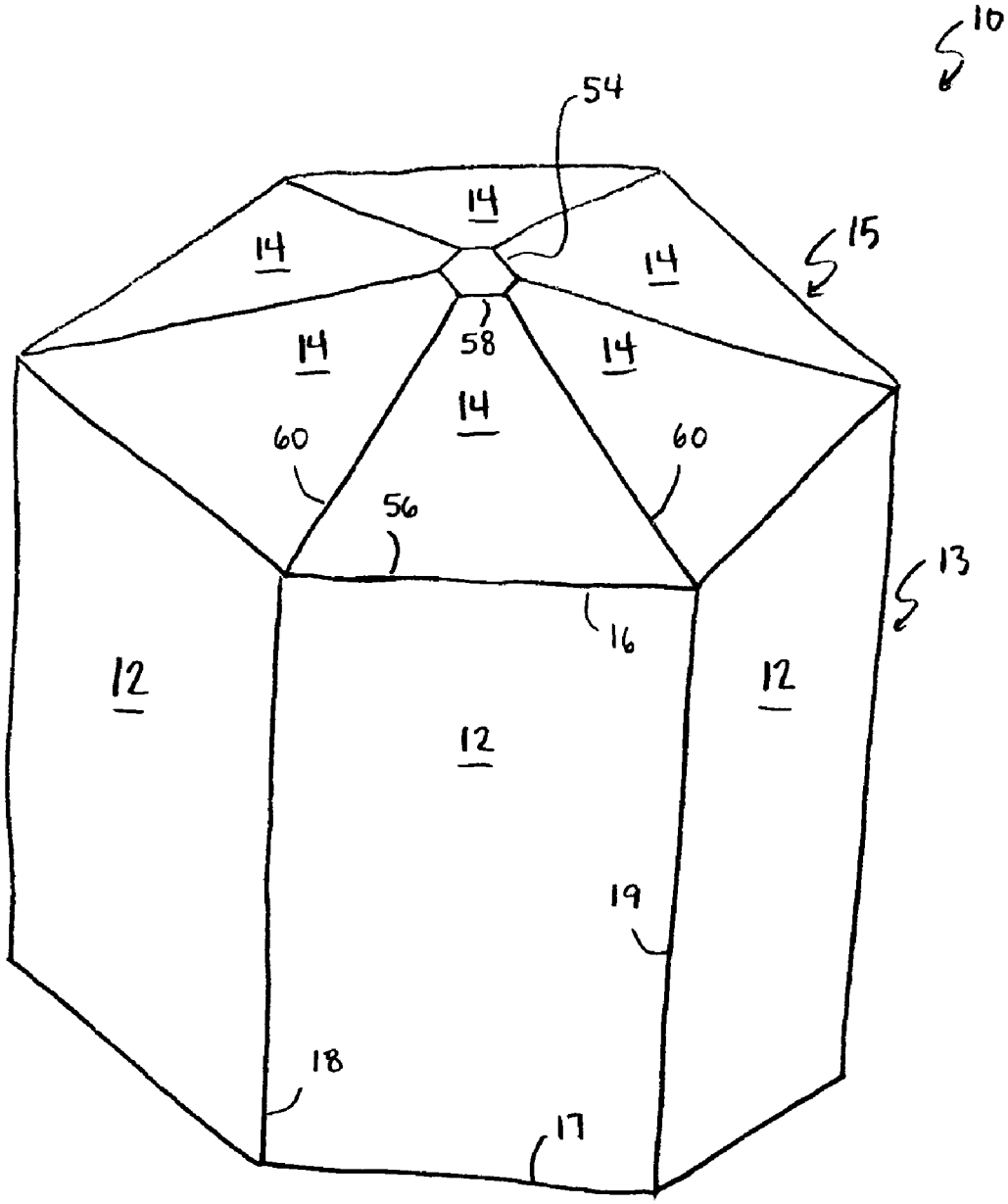
FIG. 1 is a schematic view of panel lock building system according to an exemplary embodiment of the invention.

As shown in FIGS. 1-13C the present invention is directed to a panel lock building system and a hinge for use in panel lock building system. For example, FIG. 1 shows a schematic view of a panel lock building system 10 according to an exemplary embodiment of the invention. As shown, the panel lock building system 10 includes a plurality of side panels 12 arranged in a predetermined configuration to form an enclosure 13. In the depicted embodiment of FIG. 1, adjacent ones of the plurality of side panels 12 are removably connected to form a hexagonal shaped enclosure. However, as described below, in other embodiments the side panels 12 may be arranged in any appropriate configuration.

As is also shown in FIG. 1, a plurality of roof panels 14 are connected to the enclosure 13 to form a roof structure 15. For example, in the depicted embodiment of FIG. 1 each side panel 12 is removably connected to a roof panel 14, such that the roof panels 14 combine to form the roof structure 15.

Although not shown in FIG. 1, a plurality of floor panels (discussed below) may also be connected to the side panels 12 to form a floor structure to the side panel enclosure 13. In addition, a plurality of footings (discussed below) may be connected to the side panels 12 to form a foundation to the panel lock building system 10 to increase the stability of the panel lock building system 10.

As shown in FIG. 1, each side panel 12 is substantially rectangular in shape, having an upper edge 16, a lower edge 17, a left side edge 18 and a right side edge 19. In one embodiment, the length along the side edges 18 and 19 of each side panel 12 is approximately 7½ feet; the width along the upper and lower edges 16 and 17 of each side panel 12 is approximately 8 feet; and the thickness of each side panel 12 is approximately 4½ feet. Although in other embodiments, side panels 12 of any appropriate shape and dimensions may be used.

Figure 2:
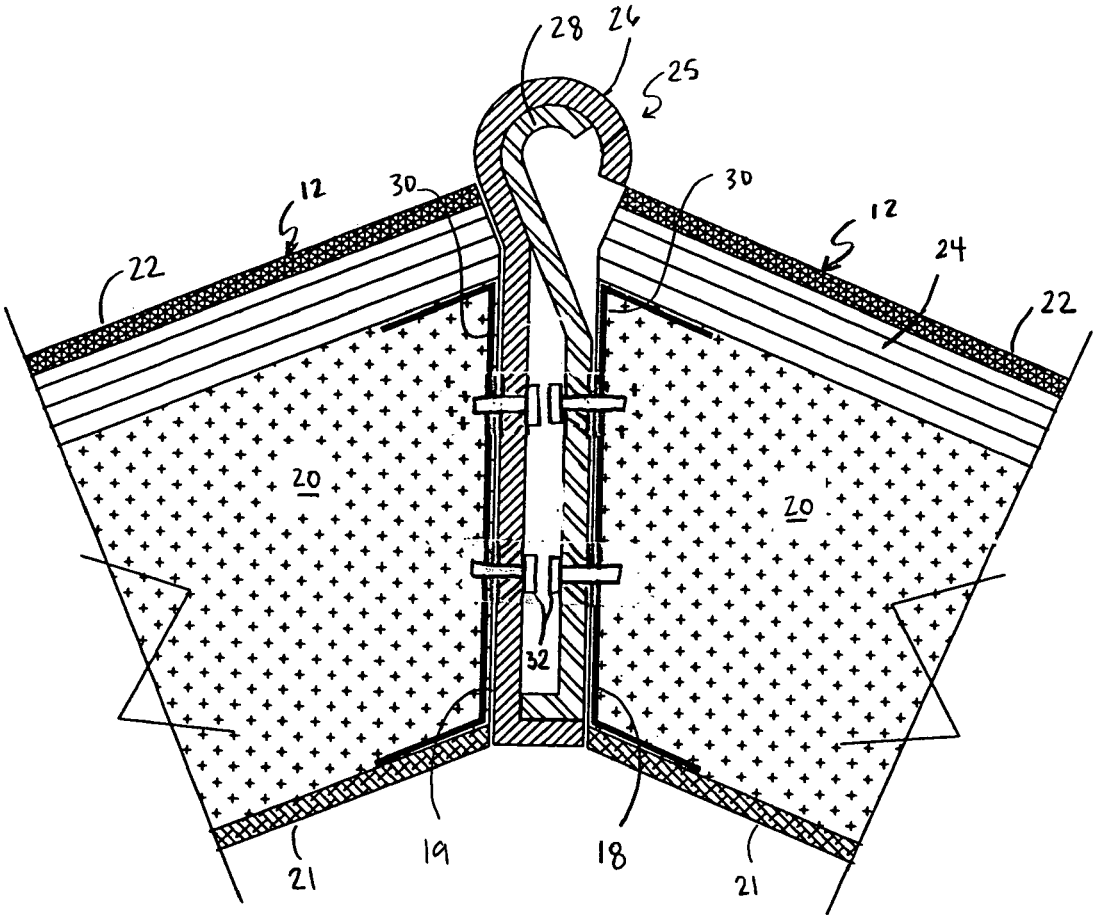
FIG. 2 is a cross-sectional view of connected side panels of the panel lock building system of FIG. 1.

FIG. 2 shows a cross-sectional view of adjacent side panels 12. As shown, each side panel 12 includes an inner surface 21, an outer surface 22 and a core 20 disposed between the inner and outer surfaces 21 and 22. In one embodiment, the core 20 is composed of a light weight material, such as a solid foam material, for example polystyrene, among other appropriate materials.

The inner and outer surfaces 21 and 22 are each composed of a stronger and/or harder material than that of the core 20 to protect the core 20, and may also serve to produce a more aesthetically appealing overall appearance. For example, in one embodiment the outer surface 22 is composed of a sheet vinyl siding and the inner surface 21 is composed of a decorative wood panel. As is also shown, a reinforcing material 24, such as a ½ inch thick layer of OSB (Oriented Strand Board), may be disposed between the outer surface 22 and the core 20 to add strength and structural stability to the side panel 12.

As shown in the embodiment of FIG. 2, each side panel 12 is removably connected to an adjacent side panel 12 by use of a hinge 25, which forms a seal between adjacent side panels 12. In the embodiment of FIG. 2, the hinge 25 includes an outer hinge half 26 removably connected to an inner hinge half 28. As shown, the outer hinge half 26 is connected to the right side edge 19 of each side panel 12 and the inner hinge half 26 is connected to the left side edge 18 of each side panel 12. A stud 30, such as a wooden or metal stud, may be attached to the core 20 of the left and right side edges 18 and 19 of each side panel 12 to facilitate attachment of the outer and inner hinge halves 26 and 28 to the left and right side edge 18 and 19. The outer and inner hinge halves 26 and 28 may be attached to the left and right side edges 18 and 19, respectively, by one or more fasteners 32, for example screw fasteners or rivets.

Figure 3A:
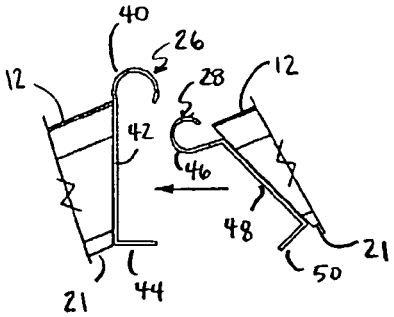
FIGS. 3A-3E shown the connection of an outer hinge half to an inner hinge half to form the connected side panels of FIG. 2.
Figure 3B:
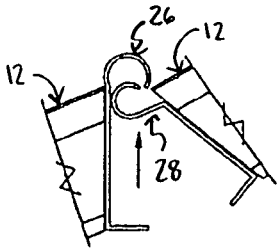

FIGS. 3A-3E show the connection of the outer hinge half 26 to the inner hinge half 28 to connect the adjacent side panels 12 (Note that for clarity purposes, some of the details from FIG. 2 have not been included in FIGS. 3A-3E.) As shown in FIGS. 3A-3E, the outer hinge half 26 includes a socket 40, a foot 44 and an arm 42 extending therebetween; and the inner hinge half 28 includes a head 46, a foot 50 and an arm 48 extending therebetween. To connect the outer hinge half 26 to the inner hinge half 28, the head 46 of the inner hinge half 28 is moved into close proximity to the socket 40 of the outer hinge half 26 as shown in FIGS. 3A and 3B.

Figure 3C:
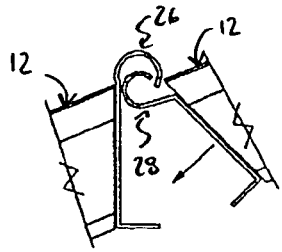
Figure 3D:
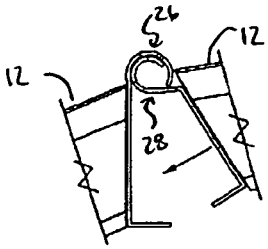
Figure 3E:
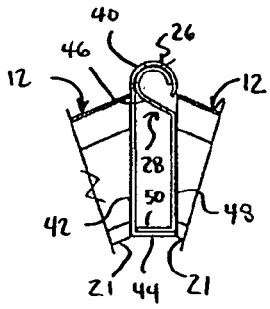

The head 46 of the inner hinge half 28 is then moved upwardly into the socket 40 of the outer hinge half 26 and rotated therein as shown in FIGS. 3C-3E. The head 46 of the inner hinge half 28 is rotated with respect to the socket 40 of the outer hinge half 26 until the foot 50 of the inner hinge half 28 contacts the arm 42 of the outer hinge half 26, such that the foot 50 of the inner hinge half 28 overlaps the foot 44 of the outer hinge half 26 to form a seal between the inner surfaces 21 of the adjacent side panels 12. The outer and inner hinge halves 26 and 28 thus connected form an interlocking connection. In one embodiment, as shown for example in FIG. 2, the socket 40 and head 46 of the hinge halves 26 and 28 extend from the outer surface 22 of adjacent side panels 12, while the feet 50 and 44 of the hinge halves 26 and 28 are adjacent to the inner surfaces 21 of adjacent side panels 12.

As shown, when the outer and inner hinge halves 26 and 28 are connected, the outer hinge half arm 42 is spaced apart from the inner hinge half arm 48. Although not shown, a sealing element, such as a foam or rubber seal may be disposed between and in contact with an inner surface of each arm 42 and 48 to form a seal therebetween to increase the sealing efficiency of the hinge 25 with respect to the inner surfaces 21 of the adjacent side panels 12.

In one embodiment, the socket 40 of the outer hinge half 26 and the head 46 of the inner hinge half 28 have substantially similar or mating shapes. For example, in the depicted embodiment of FIGS. 3A-3E, the socket 40 and the head 46 are each substantially circular. In one embodiment, an inner surface of the socket 40 has a radius of approximately ⅜ of an inch, and an outer surface of the head 46, which contacts the inner surface of the socket 40, has a radius of approximately 5⁄16 of an inch. However, in other embodiments, the socket 40 and the head 46 may have any appropriate corresponding shapes with any appropriate dimensions. In one embodiment, the hinge 25 is composed of a metal material such as steel or aluminum, among other appropriate materials, for example the hinge 25 may be composed of vinyl for lower cost applications.

Figure 4:
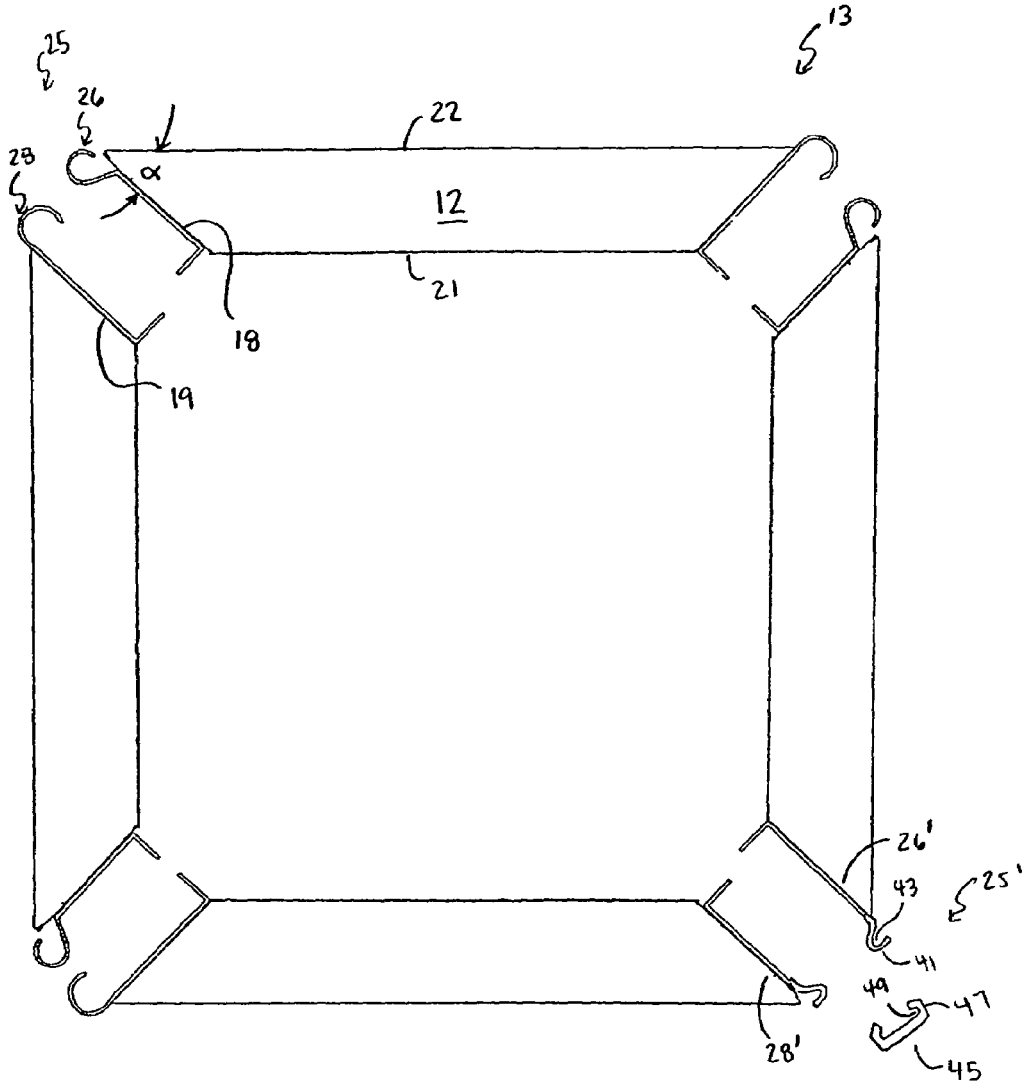
FIG. 4 is a top view of a side panel enclosure according to an exemplary embodiment of the invention.

FIG. 4 shows an exploded top view of a side panel enclosure 13 having four side panels 12 arranged in a square configuration. In order for the four side panels 12 to mate in such an arrangement, the left and right side edges 18 and 19 should each be formed at an angle $\alpha$ of approximately 45° extending outwardly from the inner surface 21 of each side panel 12 to the outer surface 22 of each side panel 12. Adjacent side panels 12 may then be connected by connecting the inner hinge half 28 of one side panel 12 to the outer hinge half 26 of an adjacent side panel 12 as described above with respect to FIGS. 3A-3E.

In one embodiment, as shown in FIG. 4 each pair of adjacent side panels 12 is connected by connecting the inner hinge half 28 of one side panel 12 to the outer hinge half 26 of an adjacent side panel 12 except for one of the adjacent side panels 12. This pair is connected by a clasping hinge 25'. The clasping hinge 25' is substantially similar to the previously described interlocking hinge 25 and may be connected to adjacent side panels 12 as described above. A difference between the interlocking hinge 25 and the clasping hinge 25' is that whereas the interlocking hinge 25 includes the outer hinge half 26 with the socket 40 and the inner hinge half 28 with the head 46 that interlockingly connects with the socket 40, the clasping hinge 25' includes a first hinge half 26' and a second hinge half 28' each having fingers 41 with a groove 43 extending therealong.

A clasp 45 connects the first hinge half 26' to the second hinge half 28' such that the first and second hinge halves 26' and 28' are not movable relative to each other. In one embodiment, the clasp 45 includes fingers 47 having grooves 49 extending therealong. Each finger 47 of the clasp 45 mates with a corresponding finger 41 on either the outer hinge half 26' or the inner hinge half 28' to secure the outer hinge half 26' to the inner hinge half 28'. For example, the clasp 45 may be slid over the hinge halves 26' and 28' and lowered thereon until the clasp 45 reaches protrusions or tongues (not shown) that extend from the hinge half fingers 41 to support the clasp 45.

In one embodiment, each pair of adjacent side panels 12 is connected by the interlocking hinge 25 and one pair of adjacent side panels 12 is connected by the clasping hinge 25'. In forming the side panel enclosure, the pair of side panels 12 having the clasping hinge 25' is connected last. This clasping hinge 25' closes the side panel enclosure 13 and prevents any of the side panels 12 that make up the side panel enclosure 13 from moving relative to one another.

A side panel enclosure 13 having any desired number of side panels 12 for forming any desired geometric configuration may be made by producing side panels 14 having left and right side edges 18 and 19 at an angle $\alpha$ determined by dividing 360° by the number of desired sides and then dividing that result by 2. As such, side panel enclosures 13 having thirty two or more sides occupying an enclosed area of 4568 square feet or more can be made.

Referring back to FIG. 1, each roof panel 14 is approximately trapezoidal in shape, having a base edge 56, a top edge 58 and side edges 60 extending therebetween. The dimensions of the roof panel 14 are largely determined by the width dimension of the side panels 12, which together form the outer perimeter of the side panel enclosure 13. Preferably the roof panels are sized to cover the open upper end of the side panel enclosure 13.

Figure 5:
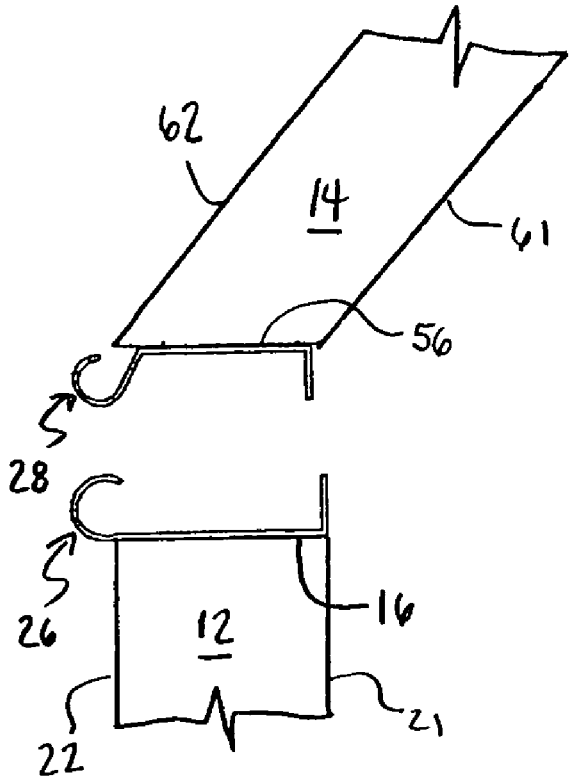
FIG. 5 is a disassembled side view of a side panel and a roof panel from the panel lock building system of FIG. 1.

FIG. 5 shows a cross-sectional view of one of the side panels 12 exploded from a corresponding one of the roof panels 14. In one embodiment, each side panel 12 is removably connected to a corresponding roof panel 14. For example, in the embodiment of FIG. 5, to connect one of the side panels 12 to a corresponding one of the roof panels 14, one of the outer hinge halves 26 is connected along the width of the side panel 12 at the upper edge 16 of the side panel 12, such as by a fastener (not shown), and one of the inner hinge halves 28 is connected along the base 56 of the roof panel 14, such as by a fastener (not shown.) The roof panel 14 is then connected to the side panel 12 by connecting the inner hinge half 28 to the outer hinge half 26 as described above with respect to FIGS. 3A-3E. As such, the hinge 25 forms a seal between the inner surfaces of the connected side panel 12 and roof panel 14.

Figure 6:
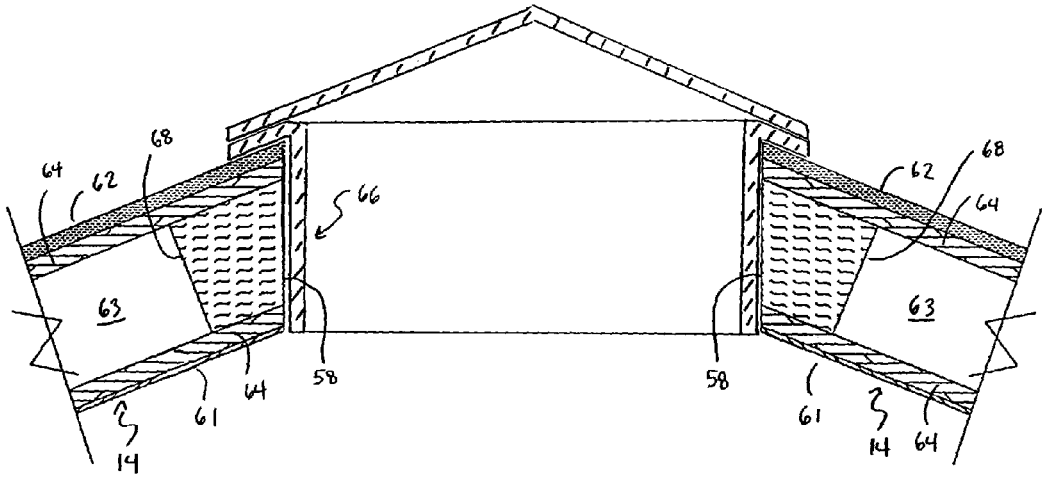
FIG. 6 is cross-sectional view of connected roof panels of the panel lock building system of FIG. 1.

As shown in FIG. 6, each roof panel 14 includes an inner surface 61, an outer surface 62 and a core 63 disposed between the inner and outer surfaces 61 and 62. In one embodiment, the core 63 is composed of a light weight material, such as a solid foam material, for example polystyrene, among other appropriate materials.

The inner and outer surfaces 61 and 62 are each composed of a stronger and/or harder material than that of the core 63 to protect the core 63, and may also serve to produce a more aesthetically appealing overall appearance. For example, in one embodiment the outer surface 62 is composed of a roofing surface, such as a vinyl roofing surface and the inner surface 61 is composed of a vinyl coating. As is also shown a reinforcing material 64, such as a ½ inch thick layer of OSB, may be disposed between the outer surface 62 and the core 63, as well as between the inner surface 61 and the core 63 to add strength and structural stability to the roof panel 14.

As shown in the embodiment of FIG. 6, the top edge 58 of each roof panel 14 is connected to a connector ring 66, such as by fasteners (not shown), to allow for tolerancing errors in the production of the roof panels 14 and to interconnect each of the roof panels 14 to form the roof 15 of the panel lock building system 10. In one embodiment, in order to facilitate connection of the top edge 58 to the connector ring 66 and to provide a strong surface to receive the fasteners, a section 68 of the top edge 58 which abuts the connector ring 66 is made of a relatively strong material, such as wood. For the same purpose, in one embodiment the connector ring 66 is made of a strong material, such as a metal material.

In one embodiment, the connector ring 66 is generally cylindrical having a hollow interior for receiving fasteners, which connect the ring 66 to the corresponding roof panels 14. In embodiments where the connector ring 66 has an open upper end, a cap 54 may be connected to the connector ring 66. The cap 54 is also preferably made of a strong material, such as a metal material.

Figure 7:
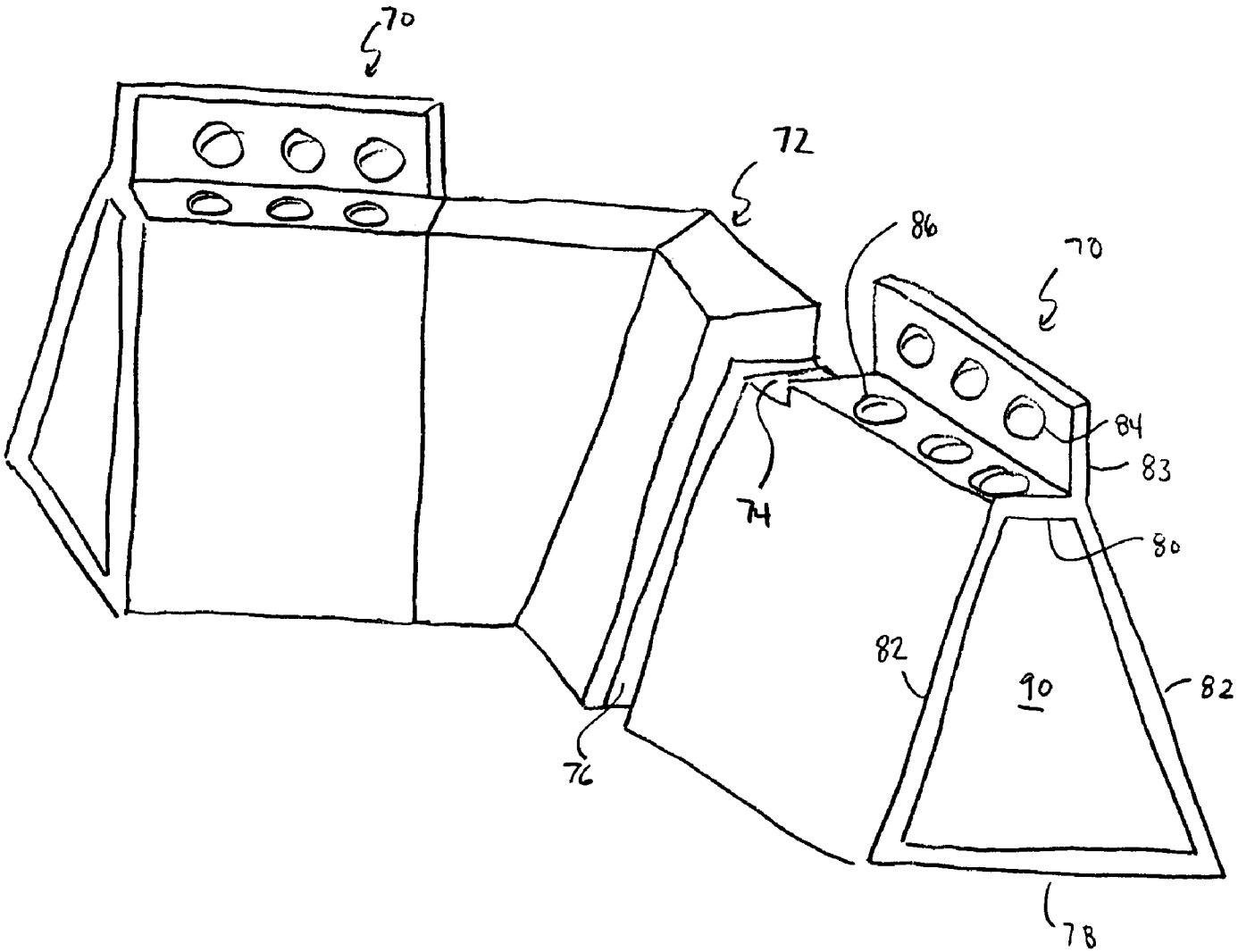
FIG. 7 is a perspective view of footings attached by a connector forming a foundation for the panel lock building system of FIG. 1.

FIG. 7 shows footings 70 each for attachment to the lower edge 17 of a corresponding one of the side panels 12 to form a foundation to increase the stability of the panel lock building system 10. Although only a portion of the length of each footing 70 is shown in FIG. 7, in one embodiment each footing 70 extends substantially along the entire width of a corresponding one of the side panels 12.

As shown in FIG. 7, a connector 72 connects adjacent footings 70. A plurality of the footings 70 may be connected to a corresponding plurality of the connectors 72 to form an enclosure of a predetermined configuration to match the predetermined configuration of the side panel enclosure 13. The right side of FIG. 7 shows one of the footings 70 disassembled from one of the connectors 72. In this embodiment, an end of the footing 70 includes a notch 74 that slides within an opening 76 in the connector 72. The notch 74 allows the outer surfaces of the end of the footing 70 to connect flushly with the outer surfaces of the connector 72 to give the appearance of a continuous part. After connection, the footing 70 may be glued to the connector 72, such as by a cement.

The left side of FIG. 7 shows one of the footings 70 assembled with one of the connectors 72. In one embodiment, each footing 70 and each connector 72 is composed of a plastic material, such as PVC (polyvinyl chloride), and adjacent ones of the footings 70 and connectors 72 are glued together, such as by PVC cement, to form a water tight seal therebetween.

As shown in FIG. 7, each footing 70 is generally trapezoidal in shape having a base 78, a top 80 and sides 82 extending therebetween. The base 78, the top 80 and the sides 82 define a generally hollow interior 90. The top 80 of each footing 70 includes openings 86 that extend into the hollow interior 90. These openings 86 allow a high weight material 92 (see FIG. 8), which is much heavier than the footing material, to be poured into each footing 70 to fill the interior 90 of the footing 70 to add weight and stability to the footing 70, and hence to the panel lock building system 10 as a whole. The high weight material may be concrete, sand, water or another appropriate material.

Figure 8:
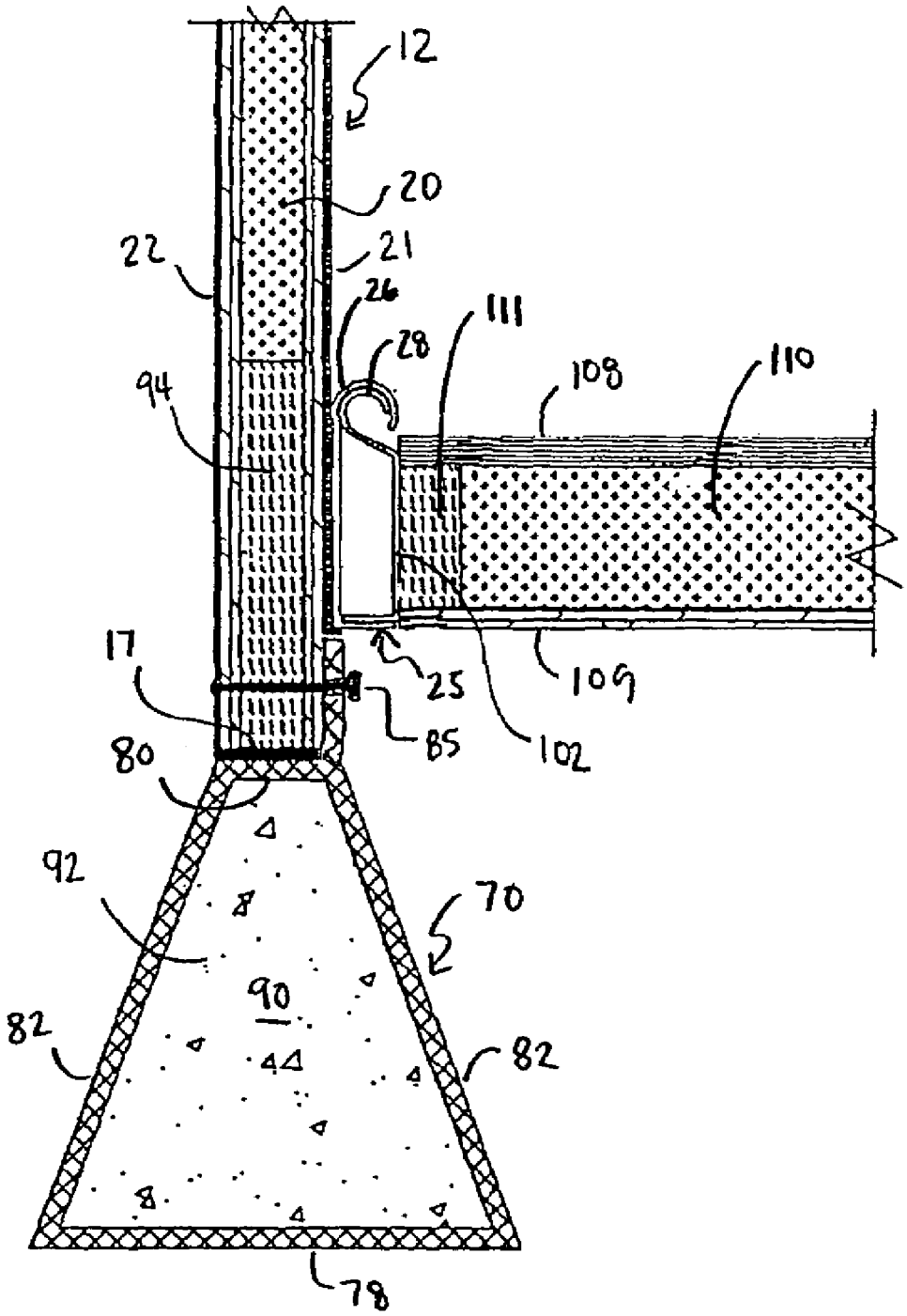
FIG. 8 is a cross-sectional view of a side panel of the panel lock building system of FIG. 1 connected to both a floor panel and a footing.

As is also shown in FIG. 7, an arm 83 extends from the top 80 of each footing 70 to form a flange or bracket having one or more openings 84 for receiving a fastener 85 (as shown in FIG. 8) for connecting the footing 70 to a corresponding one of the side panels 12. FIG. 8 shows one of the footings 70 connected to a corresponding one of the side panels 12 as described above. As shown, the lower edge 17 of the side panel 12 abuts the top 80 of the footing 70. One or more fasteners 85 may be used to connect the side panel 12 to the footing 70. The side panel 12 may include the inner surface 21, the outer surface 22 and the core 20 as described above. In addition, a lower end 94 of the side panel 12 may be composed of a strong material, such as wood, to provide a strong surface for attaching the fastener 85 thereto to facilitate connecting the side panel 12 to the footing 70.

Figure 9:
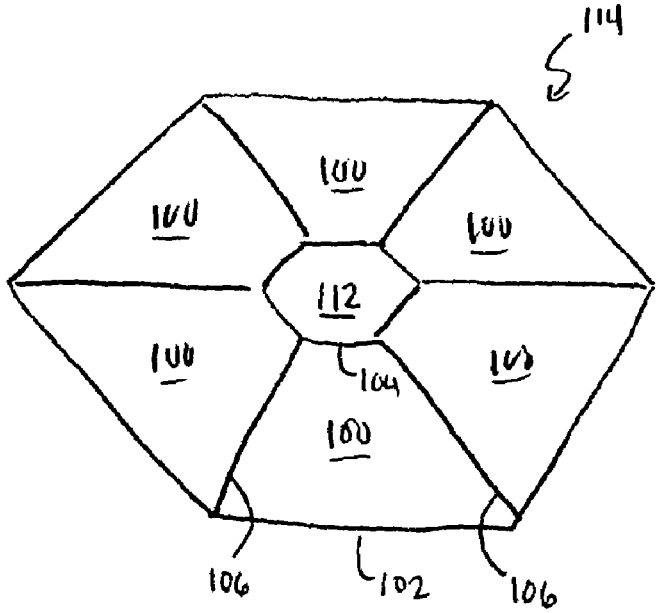
FIG. 9 is top view of a floor of the panel lock building system of FIG. 1.

As is also shown in FIG. 8, each side panel 12 is connected to a floor panel 100 (as shown in FIGS. 8 and 9.) As shown, each floor panel 100 is approximately trapezoidal in shape, having a base edge 102, an inner edge 104 and side edges 106 extending therebetween. The dimensions of the floor panel 100 are largely determined by the width dimension of the side panels 12, which together form the outer perimeter of the side panel enclosure 13. Preferably the floor panels 100 are sized to cover the open lower end of the side panel enclosure 13.

As shown in FIG. 8, each floor panel 100 includes an upper surface 108, a lower surface 109 and a core 110 disposed between the upper and lower surfaces 108 and 109. In one embodiment, the core 110 is composed of a light weight material, such as a solid foam material, for example polystyrene, among other appropriate materials.

The upper and lower surfaces 108 and 109 are each composed of a material and is stronger and/or harder than the core 110 to protect the core 110, and may also serve to produce a more aesthetically appealing overall appearance. For example, in one embodiment the upper surface 108 is composed of a sheet of plywood that is approximately ¾ inches thick and the lower surface 109 is composed of a ½ inch thick layer of OSB.

As shown in the embodiment of FIG. 8, the base edge 102 of each floor panel 100 is attached to a corresponding one of the side panels 12 by use of the previously described hinge 25. For example, one of the inner hinge halves 28 may be connected to the base edge 102 of the floor panel 100, and one of the outer hinge halves 26 may be attached to the lower end 94 of a corresponding one of the side panels 12. The outer and inner hinge halves 26 and 28 may then be connected as described above with respect to FIGS. 3A-3E. As such, the hinge 25 forms a seal between the inner surfaces of the connected side panel 12 and floor panel 100.

In one embodiment, the inner hinge half 28 is attached to the base edge 102 of the floor panel 100 by one or more fasteners (not shown), such as stainless steel screws. To facilitate this attachment an end portion 111 of the base edge 102 of the floor panel 100 may be composed of a strong material, such as wood. Similarly, the lower end 94 of the side panel 12 may be composed of a strong material, such as wood, to facilitate attaching the outer hinge half 26 to the lower end 94 of the side panel 12.

When one of the floor panels 100 is attached to a corresponding one of the side panels 12 for each one of the side panels 12 forming the side panel enclosure 13, the floor panels 100 combine to form a floor 114 as shown in FIG. 9. In one embodiment, as shown in FIG. 9, the inner edges 104 of each floor panel 100 are attached to a plug or connector 112 to allow for tolerancing errors in the production of the floor panels 100 and to interconnect each of the floor panels 100 to form the floor 114 of the panel lock building system 10.

Figure 9A:
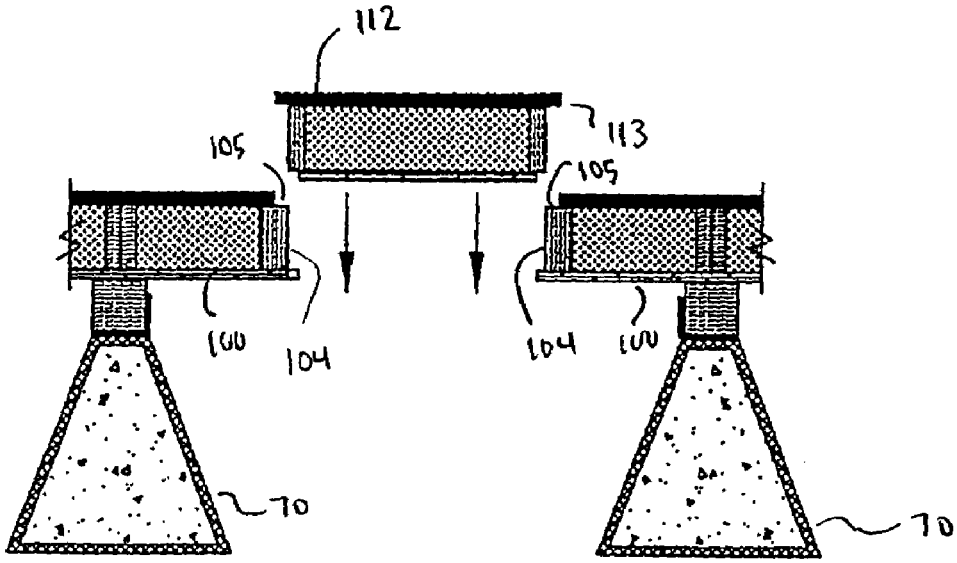
FIG. 9A is a cross-sectional view of the floor of FIG. 9.

In the embodiment of FIG. 9A, the connector 112 includes an outwardly extending upper ring 113 that fits within notches 105 in the upper surface of each floor panels 100. The connector 112 may be placed between the each floor panel and attached thereto such as by fasteners. As is also shown in FIG. 9A, each of the floor panels 100 may be supported by one of the footings 70.

In any of the descriptions above, the relative positions of the hinge halves 26 and 28 my be reversed. For example, the outer hinge half 26 may be connected to the right side edge 18 rather than the left side edge 19 of each side panel 12 as described above, and the inner hinge half 28 may be connected to the left side edge 18 rather than the right side edge 18 of each side panel 12 as described above.

Any of the alternative hinges 125, 225, 325 and 425, as shown in FIGS. 10-12A and described below, may be used in any of the connections described above that are attached by use of the above described hinge 25, having the outer hinge half 26 and the inner hinge half 28.

Figure 10:
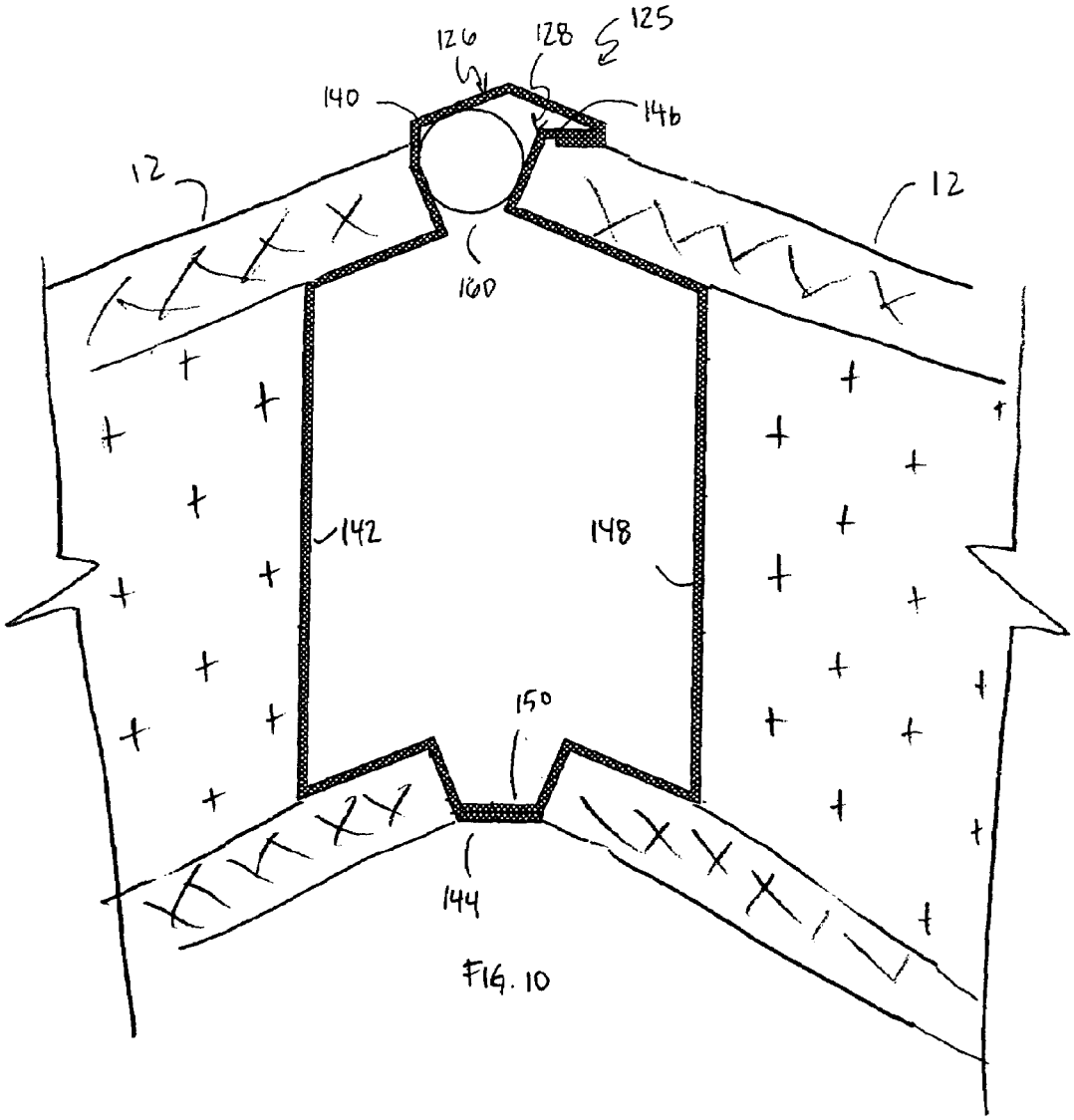
FIG. 10 is an alternative hinge for use with the panel lock building system of FIG. 1.

In the embodiment of FIG. 10, the hinge 125 includes an outer hinge half 126 and an inner hinge half 128. The outer hinge half 126 includes a socket 140, a foot 144 and an arm 142 extending therebetween; and the inner hinge half 128 includes a head 146, a foot 150 and an arm 148 extending therebetween. In addition, a sealing element 160, such as a foam or rubber seal, may be disposed between and in contact with inner surfaces of both the outer hinge half 126 and the inner hinge half 128 to create a seal therebewteen. The sealing element 160 may be connected to an inner surface of either the outer hinge half 126 and the inner hinge half 128 such as by use of an adhesive. The connection of the outer hinge half 126 to the inner hinge half 128 is substantially the same as that described above with respect to the outer and inner hinge halves 26 and 28 of the hinge 25. In one embodiment, the hinge 125 is composed of a metal material such as steel or aluminum, among other appropriate materials. For example for lower cost applications the hinge 125 may be composed of vinyl.

Figure 10A:
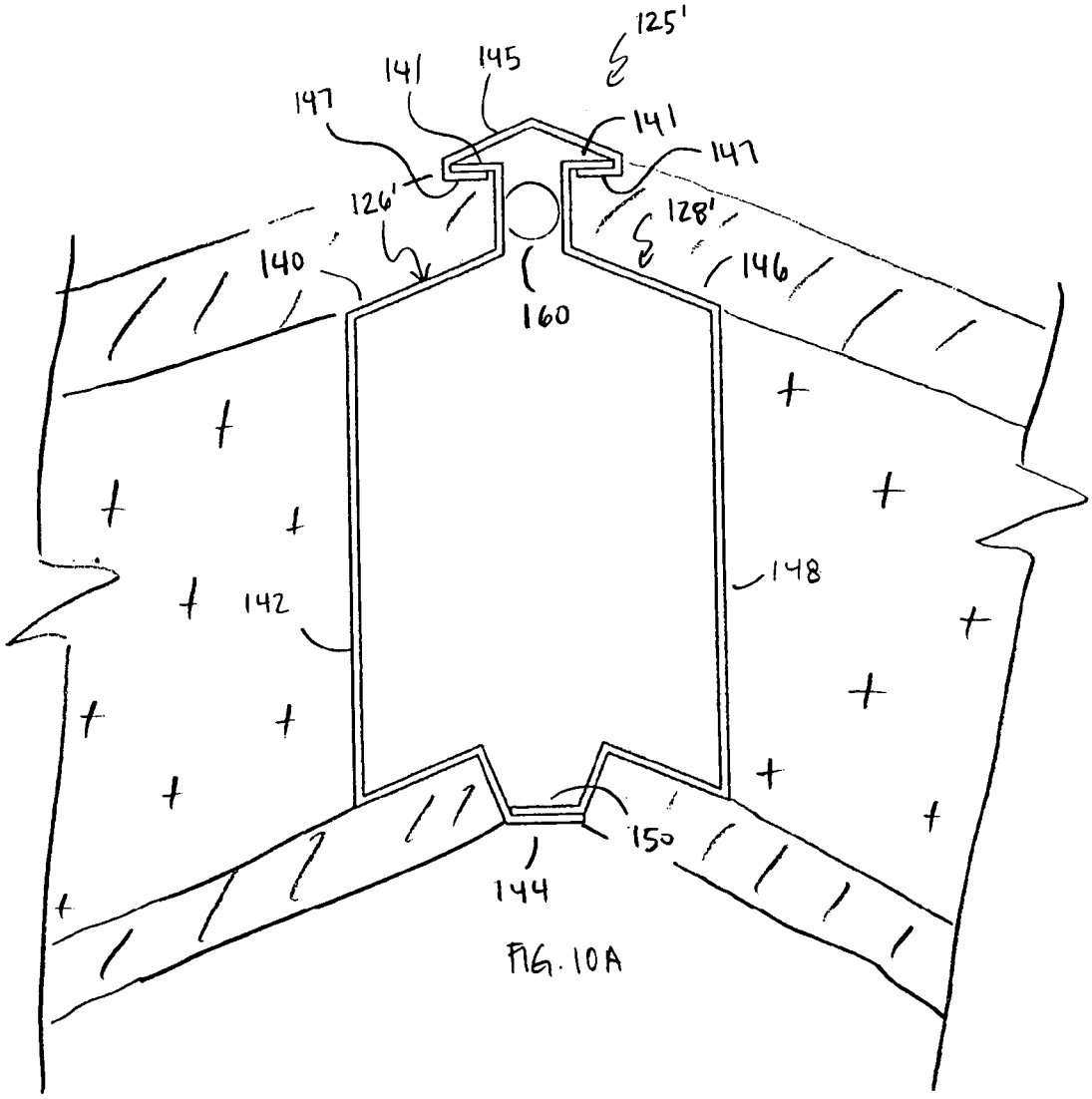
FIG. 10A is a clasp hinge for use with the panel lock building system of FIG. 1.

FIG. 10A shows a clasping hinge 125' that may be used as described above for the clasping hinge 25'. The clasping hinge 125' is substantially similar to the interlocking hinge 125 described above. A difference between the interlocking hinge 125 and the clasping hinge 125' is that whereas the interlocking hinge 125 includes the outer hinge half 126 with the socket 140 and the inner hinge half 128 with the head 146 that interlockingly connects with the socket 140, the clasping hinge 125' includes a first hinge half 126' and a second hinge half 128' each having fingers 141.

A clasp 145 connects the first hinge half 126' to the second hinge half 128' such that the first and second hinge half 126' and 128' are not movable relative to each other. In one embodiment, the clasp 145 includes fingers 147. Each finger 147 of the clasp 145 mates with a corresponding finger 141 on either the outer hinge half 126' or the inner hinge half 128' to secure the outer hinge half 126' to the inner hinge half 128'. For example, the clasp 145 may be slid over the hinge halves 126' and 128' and lowered thereon until the clasp 145 reaches protrusions or tongues (not shown) that extend from the hinge half fingers 141 to support the clasp 145.

Figure 11:
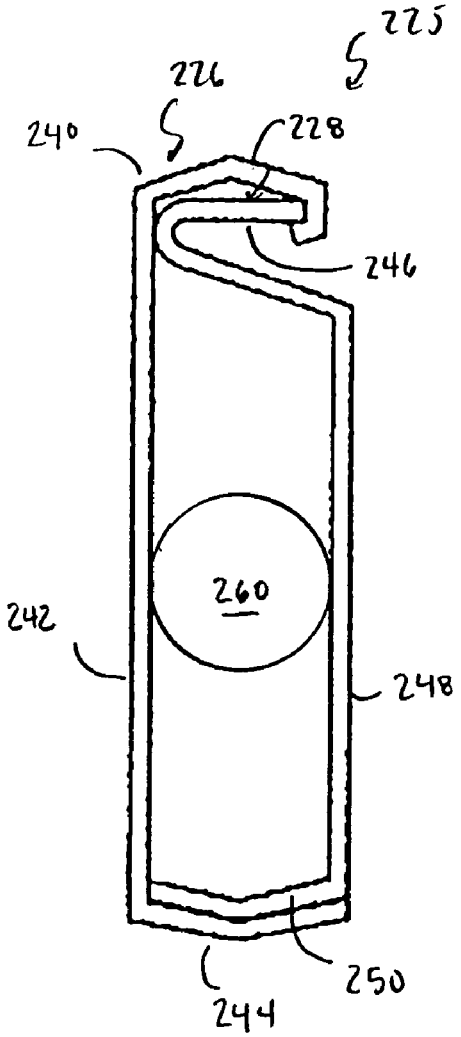
FIG. 11 is another alternative hinge for use with the panel lock building system of FIG. 1.

In the embodiment of FIG. 11, the hinge 225 includes an outer hinge half 226 and an inner hinge half 228. The outer hinge half 226 includes a socket 240, a foot 244 and an arm 242 extending therebetween; and the inner hinge half 228 includes a head 246, a foot 250 and an arm 248 extending therebetween. In addition, a sealing element 260, such as a foam or rubber seal, may be disposed between and in contact with inner surfaces of both the outer hinge half 226 and the inner hinge half 228 to create a seal therebewteen. The sealing element 260 may be connected to an inner surface of either the outer hinge half 226 and the inner hinge half 228 such as by use of an adhesive. The connection of the outer hinge half 226 to the inner hinge half 228 is substantially the same as that described above with respect to the outer and inner hinge halves 26 and 28 of hinge 25. However, in this embodiment the feet 244 and 250 are also interlockingly connected. For example, as shown in FIG. 11 the foot 244 of the outer hinge half 226 is includes a V shaped portion that removably and interlockingly receives a corresponding V shaped portion of the foot 250 of the inner hinge half 228, such that when the feet 244 and 250 are interlockingly coupled, the hinge halves 226 and 228 is separated by the application of a pulling force sufficient to disengage the V shaped portion of the inner hinge half foot 250 from the V shaped portion of the outer hinge half foot 244. In one embodiment, the hinge 225 is composed of a metal material with some flexibility, such as 16 to 20 gauge sheet metal, to allow the V shaped portion of the inner hinge half foot 250 to wedge into the inner V shaped portion of the outer hinge half foot 244. The above described interlocking feet may be incorporated into any of the hinges described herein.

Figure 11A:
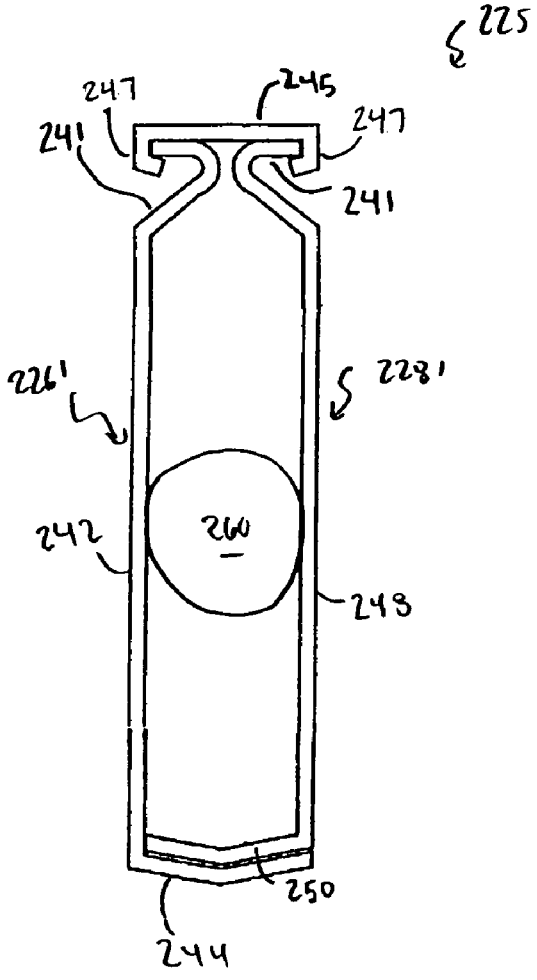
FIG. 11A is another clasp hinge for use with the panel lock building system of FIG. 1.

FIG. 11A shows a clasping hinge 225' that may be used as described above for the clasping hinge 25'. The clasping hinge 225' is substantially similar to the interlocking hinge 225 described above. A difference between the interlocking hinge 225 and the clasping hinge 225' is that whereas the interlocking hinge 225 includes the outer hinge half 226 with the socket 240 and the inner hinge half 228 with the head 246 that interlockingly connects with the socket 240, the clasping hinge 225' includes a first hinge half 226' and a second hinge half 228' each having fingers 241.

A clasp 245 connects the first hinge half 226' to the second hinge half 228' such that the first and second hinge half 226' and 228' are not movable relative to each other. In one embodiment, the clasp 245 includes fingers 247. Each finger 247 of the clasp 245 mates with a corresponding finger 241 on either the outer hinge half 226' or the inner hinge half 228' to secure the outer hinge half 226' to the inner hinge half 228'. For example, the clasp 245 may be slid over the hinge halves 226' and 228' and lowered thereon until the clasp 245 reaches protrusions or tongues (not shown) that extend from the hinge half fingers 241 to support the clasp 245.

Figure 12:
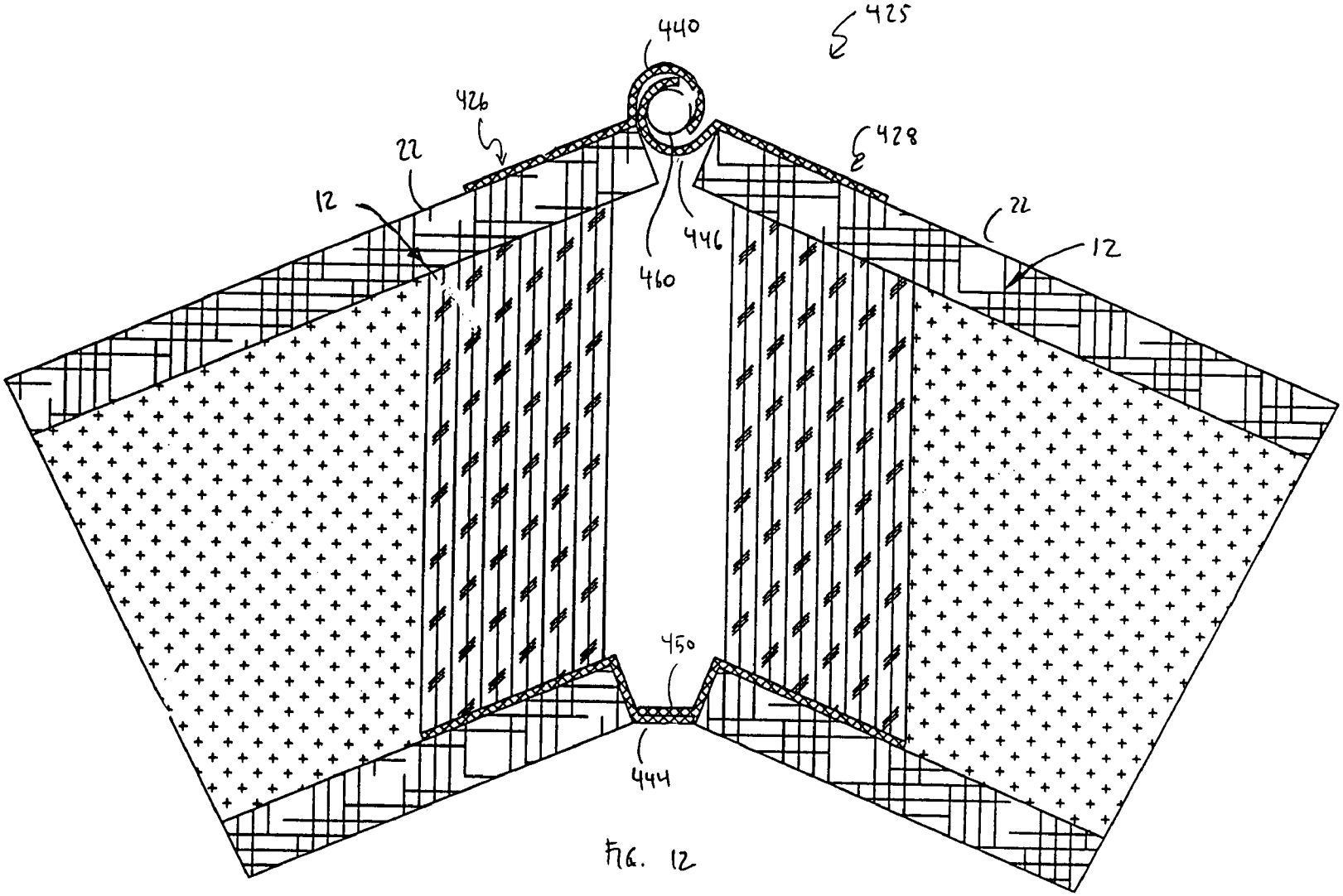
FIG. 12 is yet another alternative hinge for use with the panel lock building system of FIG. 1.

In the embodiment of FIG. 12, the hinge 425 includes an outer hinge half 426 and an inner hinge half 428. The outer hinge half 426 includes a socket 440 that is separated from a foot 444. The inner hinge half 428 includes a head 446 that is separated from a foot 450. A sealing element 460, such as a foam or rubber seal, may be disposed between and in contact with inner surfaces of both the socket 440 and the head 446. The sealing element 460 may be connected to an inner surface of either the outer hinge half 426 and the inner hinge half 428 such as by use of an adhesive. The connection of the outer hinge half 426 to the inner hinge half 428 is substantially the same as that described above with respect to the outer and inner hinge halves 26 and 28 of the hinge 25. In one embodiment, the hinge 425 is composed of a metal material such as steel or aluminum, among other appropriate materials. For example for lower cost applications the hinge 425 may be composed of vinyl.

In this embodiment the socket 440 and head 446 are separated from the feet 444 and 450, respectively, so that heat transfer is minimized between the socket 440 and the foot 444 of the outer hinge half 426, and between the head 446 and the foot 450 of the outer hinge half 428. Also, in this embodiment, the socket 440 and head 446 are attached to the outer surface 22 of adjacent side panels 12. This minimizes the likelihood of water or other debris from passing through the hinge 425 and side the side panel enclosure 13.

Figure 12A:
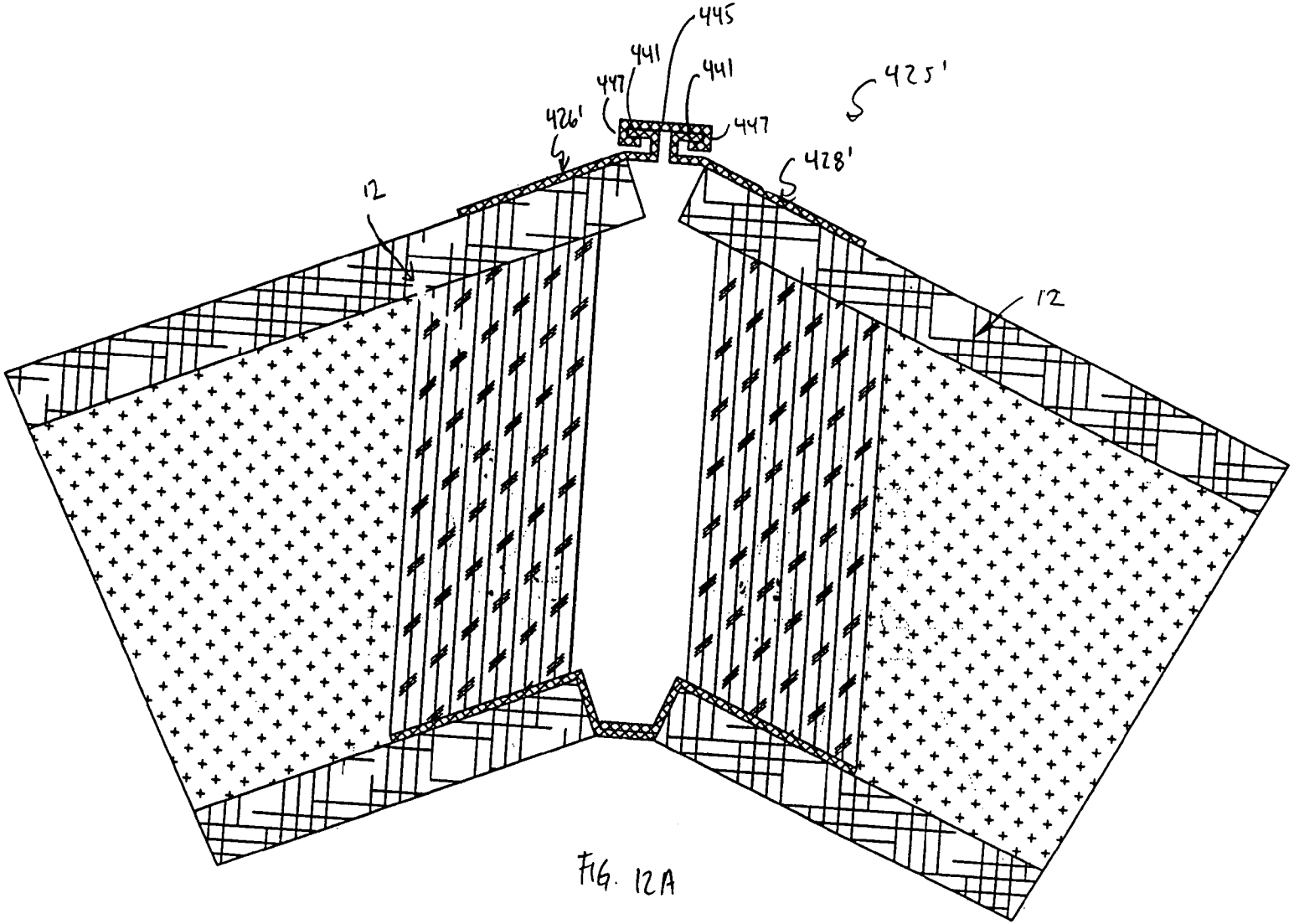
FIG. 12A is yet another clasp hinge for use with the panel lock building system of FIG. 1.

FIG. 12A shows a clasping hinge 425' that may be used as described above for the clasping hinge 25'. The clasping hinge 425' is substantially similar to the interlocking hinge 425 described above. A difference between the interlocking hinge 425 and the clasping hinge 425' is that whereas the interlocking hinge 425 includes the outer hinge half 426 with the socket 440 and the inner hinge half 428 with the head 446 that interlockingly connects with the socket 440, the clasping hinge 425' includes a first hinge half 426' and a second hinge half 428' each having fingers 441.

A clasp 445 connects the first hinge half 426' to the second hinge half 428' such that the first and second hinge half 426' and 428' are not movable relative to each other. In one embodiment, the clasp 445 includes fingers 447. Each finger 447 of the clasp 445 mates with a corresponding finger 441 on either the outer hinge half 426' or the inner hinge half 428' to secure the outer hinge half 426' to the inner hinge half 428'. For example, the clasp 445 may be slid over the hinge halves 426' and 428' and lowered thereon until the clasp 445 reaches protrusions or tongues (not shown) that extend from the hinge half fingers 441 to support the clasp 445.

Figure 13C:
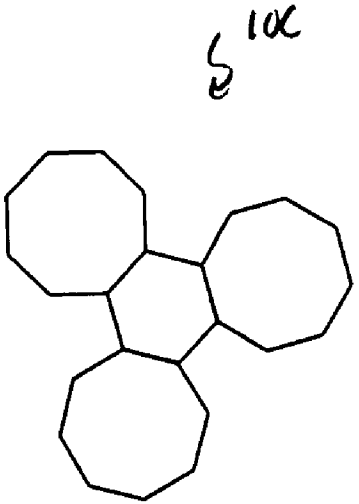
FIGS. 13A-13C show top views of enlarged panel lock building systems each having multiple panel lock building systems interconnected with each other.
Figure 13B:
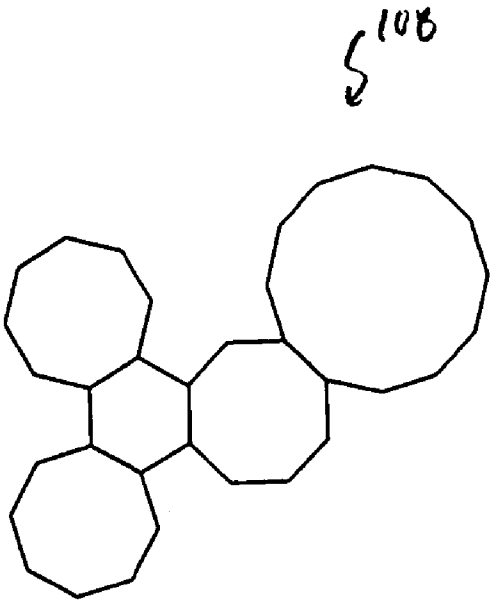
Figure 13A:
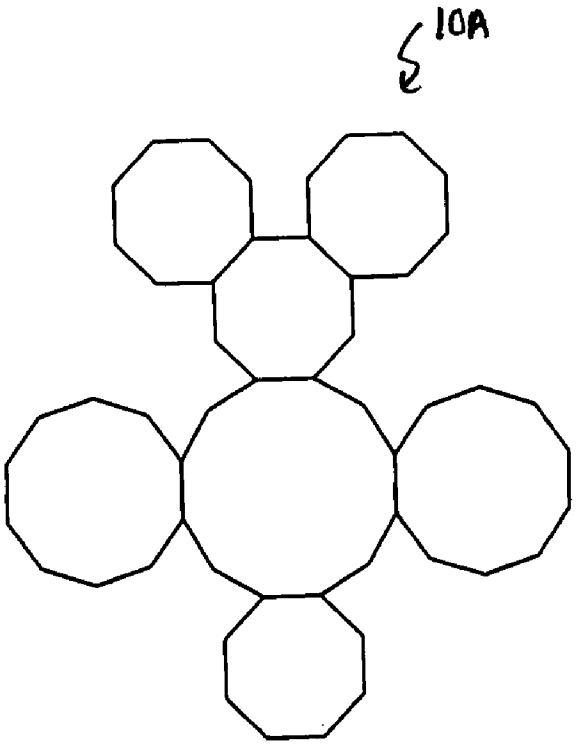

As shown in FIGS. 13A-13C, multiple panel lock building systems, each having side panel enclosure with any desired number of side panels may be interconnected to form enlarged panel lock building systems 10A-10C. Also multiple panel lock building systems may be stacked or placed in surrounding relation to each other, such as concentrically.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended claims, and all changes that come within the meaning and range of equivalents thereof are intended to be embraced therein.

I claim:

1. A panel lock building system comprising:

a plurality of side panels forming an enclosure of a predetermined configuration;

a first hinge half attached to a first side edge of a plurality of the plurality of side panels;

a second hinge half attached to a second side edge of a plurality of the plurality of side panels;

wherein each first hinge half is interlockingly coupled to a corresponding one of the second hinge halves to couple adjacent ones of the side panels; and a floor to said side panel enclosure comprising a plurality of floor panels, wherein each of the plurality of side panels is hingedly connected to a corresponding one of the plurality of floor panels, and wherein the plurality of floor panels forms a floor to said side panel enclosure;

wherein the floor further comprises a connector, and wherein each of the floor panels is connected to the connector, and wherein the connector comprises an outwardly extending ring that fits within upper notches in each of the floor panels.

2. The panel lock building system of claim 1, wherein each first hinge half comprises an arm having a socket on one end and a foot on an opposite end, and wherein each second hinge half comprises an arm having a head on one end and a foot on an opposite end, such that the head of each second hinge half is removably and interlockingly connected to the socket of the first hinge half.

3. The panel lock building system of claim 2, wherein the foot of each second hinge half is removably and interlockingly connected to the foot of the first hinge half.

4. The panel lock building system of claim 1, wherein each side panel is comprised of a light weight material.

5. The panel lock building system of claim 4, wherein each side panel comprises a foam inner core.

6. The panel lock building system of claim 1, further comprising a roof to said side panel enclosure comprising a plurality of roof panels, wherein each of the plurality of side panels is hingedly connected to a corresponding one of the plurality of roof panels, and wherein the plurality of roof panels forms a roof to said side panel enclosure.

7. The panel lock building system of claim 6, wherein the roof further comprises a connector ring, and wherein each of the roof panels is connected to the connector ring.

8. The panel lock building system of claim 7, wherein the connector ring is generally cylindrical in shape comprising a hollow interior.

9. The panel lock building system of claim 1, further comprising a plurality of footings, wherein each footing is mounted to a lower portion of a corresponding one of the plurality of side panels to add stability to said side panel enclosure.

10. The panel lock building system of claim 9, wherein each footing forms a substantially enclosed space having openings extending into a cavity and a high weight material disposed within the cavity, and wherein the high weight material is heavier than a material that comprises the footing.

11. The panel lock building system of claim 10, wherein the footing comprises a plastic material, and wherein the high weight material is concrete.

12. The panel lock building system of claim 1, wherein each side panel, each roof panel and each floor panel is comprised of a light weight material.

13. The panel lock building system of claim 12, wherein each side panel, each roof panel and each floor panel comprises a foam inner core.

* * * * *